US007358429B2

(12) United States Patent
Thoen

(10) Patent No.: US 7,358,429 B2
(45) Date of Patent: Apr. 15, 2008

(54) MAGNETIZED FRETS FOR A STRINGED MUSICAL INSTRUMENT

(76) Inventor: Lorne Thoen, 42-20th Street East, Prince Albert, Saskatchewan (CA) S6V 1K4

( * ) Notice: Subject to any disclaimer, the term of this patent is extended or adjusted under 35 U.S.C. 154(b) by 237 days.

(21) Appl. No.: 11/221,688

(22) Filed: Sep. 9, 2005

(65) Prior Publication Data

US 2006/0249003 A1 Nov. 9, 2006

(30) Foreign Application Priority Data

May 6, 2005 (CA) ..... 2506440

(51) Int. Cl.
*G10D 3/12* (2006.01)

(52) U.S. Cl. ..... 84/300; 84/267

(58) Field of Classification Search ..... 84/300, 84/470 R, 318, 297 S, 741, 267
See application file for complete search history.

(56) References Cited

U.S. PATENT DOCUMENTS 4,559,861 A * 12/1985 Patty et al. ..... 84/470 R
4,760,767 A * 8/1988 Tsurubuchi ..... 84/646
6,998,526 B1 * 2/2006 Sims et al. ..... 84/318
2003/0196538 A1 * 10/2003 Katchanov et al. ..... 84/297 S
2004/0074380 A1 * 4/2004 Fishman ..... 84/741

* cited by examiner

*Primary Examiner*—Lincoln Donovan
*Assistant Examiner*—Jianchun Qin
(74) *Attorney, Agent, or Firm*—Ryan W. Dupuis; Michael R. Williams; Adrian D. Battison

(57) ABSTRACT

The present invention is concerned with providing a fret for a stringed musical instrument having strings containing ferromagnetic material, wherein the fret is arranged to be magnetic. Having a downward magnetic force exerted on the strings by a fret ensures full and consistent contact between a string and the fret when the string is pressed down against the fret. The invention has three embodiments that describe different ways of providing magnetism to the fret. In a first embodiment the fret is comprised of magnetic material. In a second embodiment a magnet is coupled to the fret to supply magnetic properties to the fret. In a third embodiment an electromagnetic coil is wrapped around a portion of the fret in order to induce magnetism.

21 Claims, 5 Drawing Sheets

MAGNETIZED FRETS FOR A STRINGED MUSICAL INSTRUMENT

This application claims foreign priority to Canadian Patent Application No. 2,506,440, filed May 6, 2005.

The present invention relates to a fret for stringed instruments with strings comprising ferromagnetic material where the fret is arranged to be magnetic.

BACKGROUND

A stringed instrument, such as, but not limited to, a guitar, typically includes a body and a neck. The neck extends from the body and typically includes a fingerboard mounted on the top surface of the neck. A plurality of strings is arranged on the instrument such that each string is engaged to a device supported on the body at one point and extends over the fingerboard and is engaged to another device at the end of the neck at a second point. A tone is created by causing a string to vibrate between these two points. Stringed instruments often include frets that are mounted on the fingerboard such that the frets and strings are spaced apart by a predetermined distance. By pressing a string into contact with one of the frets, a third point of contact between the string and the instrument is created. Now the string is free to vibrate between the first point on the body and the third point at the fret, and because the length of the vibrating portion of the string has changed, the tone produced by such a vibration is also changed.

In order for a clear ringing tone is to be produced by the vibration of a string when pressed against a fret, care must be taken by the player of the instrument to ensure that consistent contact is made between the string and the fret. Consistent contact is ensured by pressing the string down towards the fingerboard at a point immediately adjacent to the fret on the side furthest from the instrument body with enough pressure to prevent vibration immediately above the fret. If the string vibrates immediately above the fret, a buzzing noise results from fluctuating degrees of contact between the string and fret. This problem is commonly referred to as "fret buzz."

Fret buzz is a common problem for beginning or occasional players of stringed instruments. Due to a lack of experience or lack of practice, these players may not have fully developed a proper fingering or fretting technique. Fret buzz greatly diminishes the quality of the sound produced by the instrument and can cause frustration. In some cases this frustration can dishearten a beginning player and lead to abandoning the challenge of learning to play the instrument.

SUMMARY

It is one object of the present invention to provide frets for stringed instruments with strings containing ferromagnetic material, the frets exerting a downward magnetic force on the strings to provide better contact between a string and a fret.

According to a first aspect of the present invention there is provided a fret for use with a stringed instrument, the stringed instrument having:

a body;

a neck extending from the body;

a fingerboard supported along the neck for supporting the fret thereon; and a plurality of strings spanning along the fingerboard comprised of ferromagnetic material;

the fret being arranged to emit a magnetic field.

The invention helps reduce the occurrence of fret buzz by assisting the player in applying enough force to a string to ensure proper contact with the fret. The downward magnetic force exerted on the string by the fret will compliment the downward force exerted by the player's finger on the string, increasing the total downward force and ensuring full and consistent contact between the string and fret. Reducing the amount of fret buzz during playing will increase the sound quality produced by the player, making the experience more enjoyable.

According to a second aspect of the present invention there is provided a stringed instrument comprising:

a body;

a neck extending from the body;

a fingerboard supported along the neck;

a plurality of frets supported at spaced positions along the fingerboard; and a plurality of strings spanning along the fingerboard comprised of ferromagnetic material;

the improvement comprising each fret being arranged to emit a magnetic field.

According to a third aspect of the present invention there is provided a neck for use with a stringed instrument having a body for supporting the neck to extend therefrom and a plurality of strings comprised of ferromagnetic material for spanning along the neck, the neck comprising:

a fingerboard; and a plurality of frets at spaced positions along the fingerboard, each fret being arranged to emit a magnetic field.

In a first embodiment of the present invention, each fret may comprise magnetic material for emitting the magnetic field.

Alternatively, in a second embodiment of the present invention, there may be provided a magnetic element in association with each fret for emitting the magnetic field.

In this second embodiment, preferably each magnetic element comprises magnetic material in proximity to a corresponding one of the plurality of frets.

In a further alternative according to a third embodiment of the present invention, there may be provided an electromagnetic coil in association with each fret for emitting the magnetic field.

In this third embodiment, preferably each electromagnetic coil is arranged around at least a portion of a corresponding one of the plurality of frets.

In this third embodiment, preferably there is provided a power supply for supplying current to the electromagnetic coils.

In this instance, the power supply may be mounted on a surface of the body of the stringed instrument.

Alternatively, the power supply may be mounted within a cavity recessed into the body of the stringed instrument.

BRIEF DESCRIPTION OF THE DRAWINGS

In the accompanying drawings, which illustrate exemplary embodiments of the present invention.

DETAILED DESCRIPTION

Figure 1:
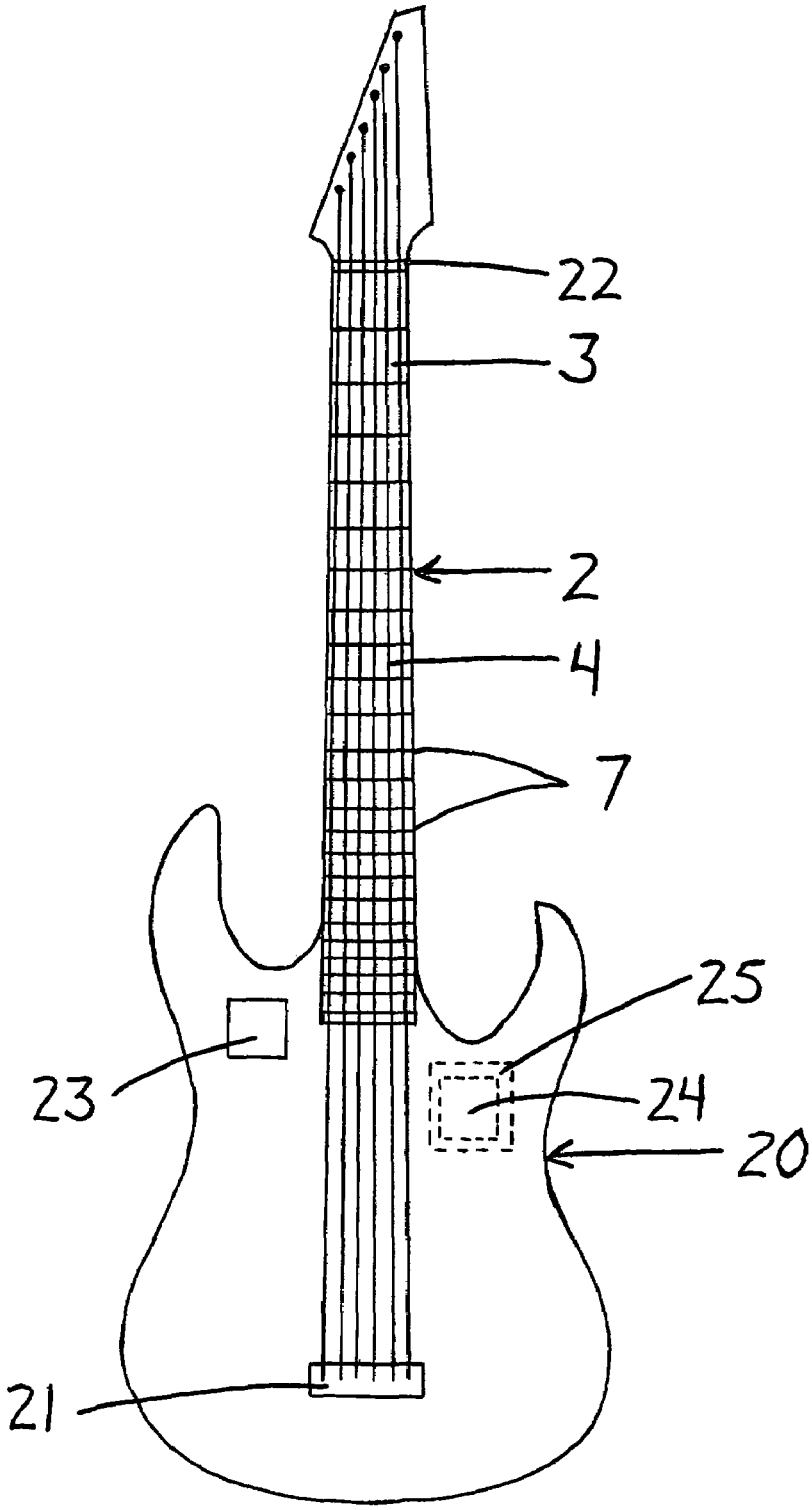
FIG. 1 is a top plan view of a typical stringed instrument.

FIG. 1 illustrates an example of a typical stringed instrument having a body 20 and a neck 2. Strings 4 are arranged on the instrument such that each string is engaged to a device supported on the body at one point 21 from which it extends over the fingerboard 3 and is engaged to another device near the end of the neck at a second point 22. The fingerboard 3 supports a series of frets 7 which protrude upwardly from its top surface so that the strings 4 are spaced a predetermined vertical distance from the frets.

Figure 2:
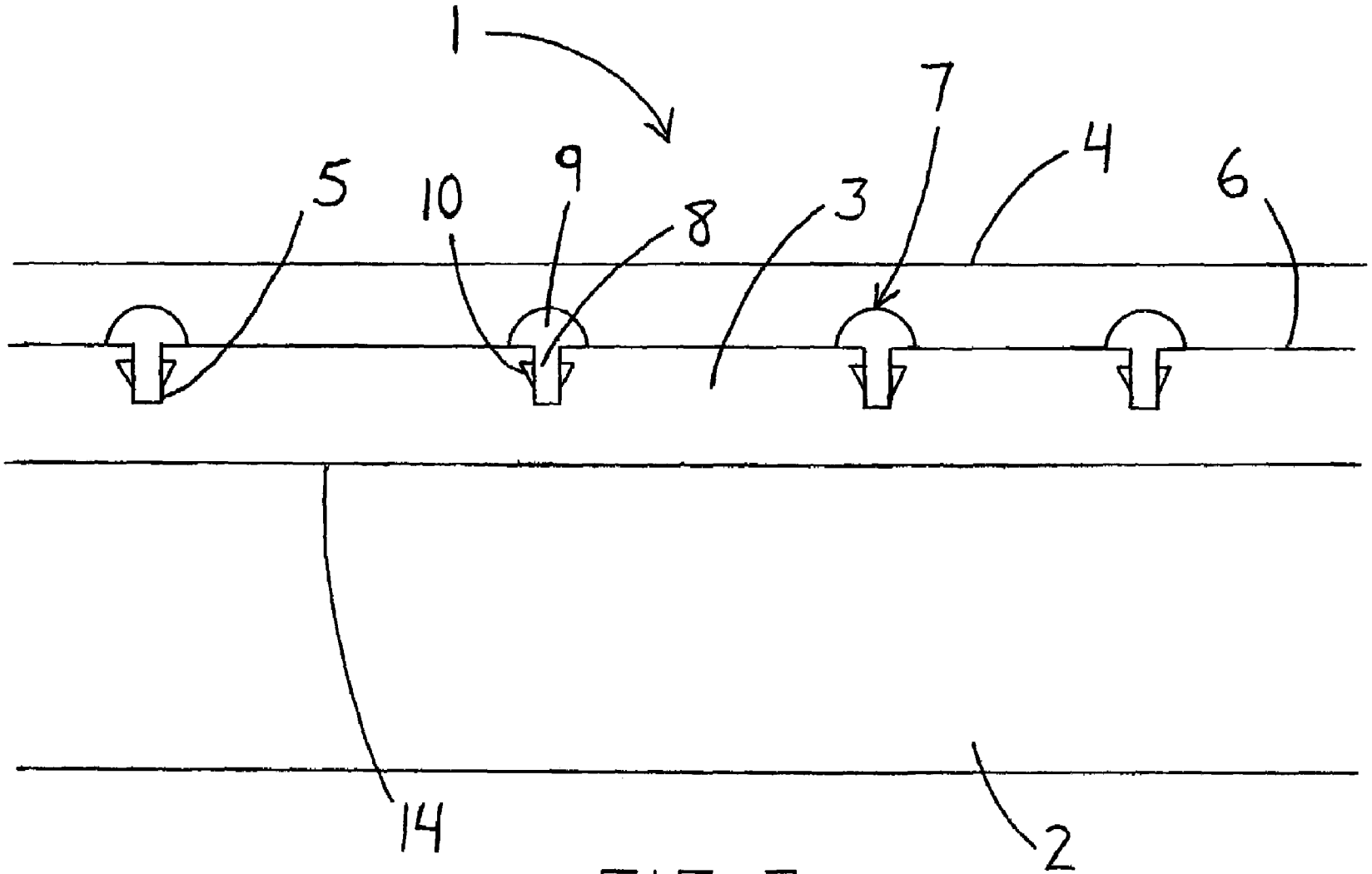
FIG. 2 is a cross sectional view of a neck assembly for a stringed instrument featuring a first embodiment of the present invention.
Figure 3:
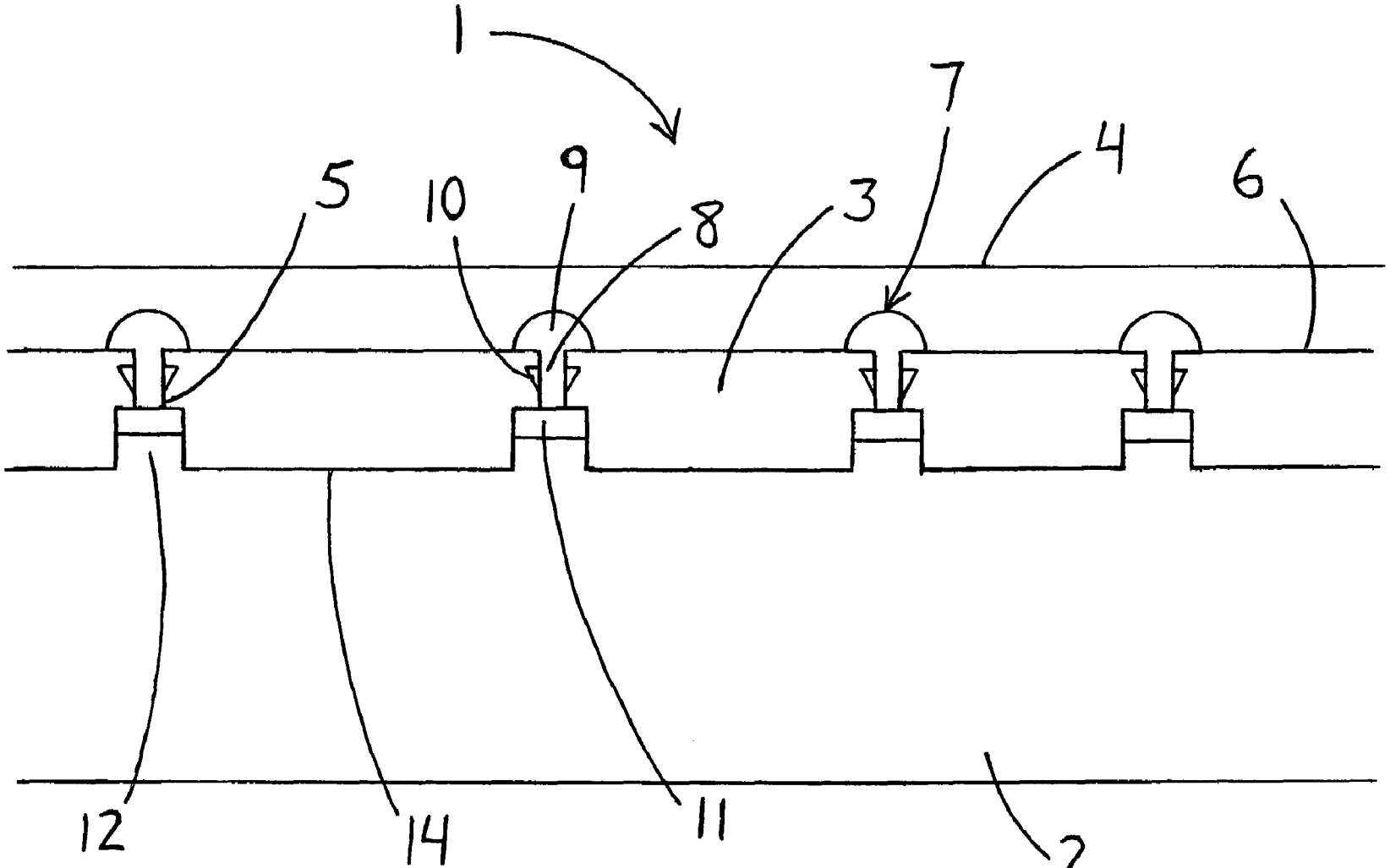
FIG. 3 is a cross sectional view of a neck assembly for a stringed instrument featuring a second embodiment of the present invention.
Figure 4:
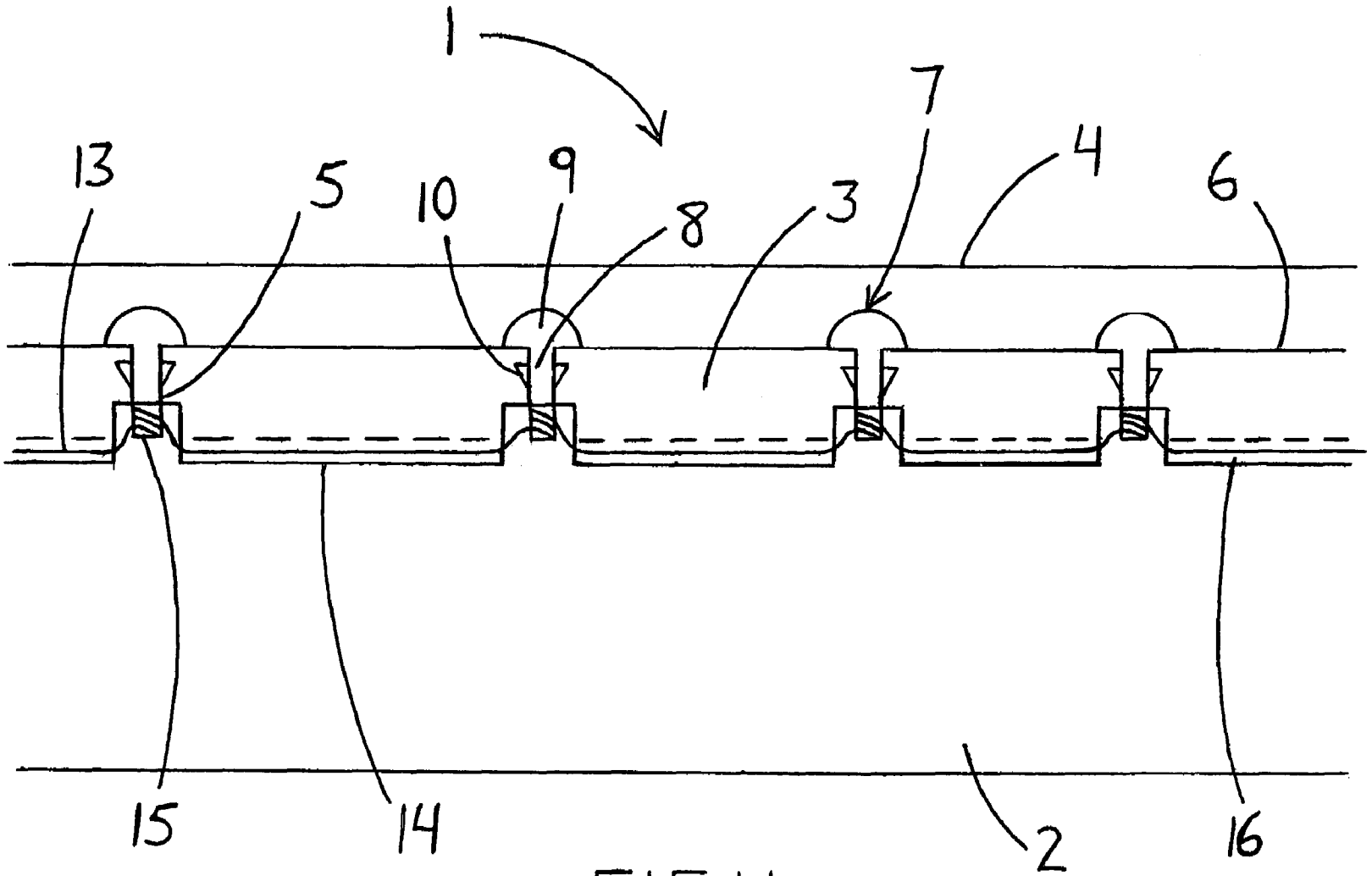
FIG. 4 is a cross sectional view of a neck assembly for a stringed instrument featuring a third embodiment of the present invention.
Figure 5:
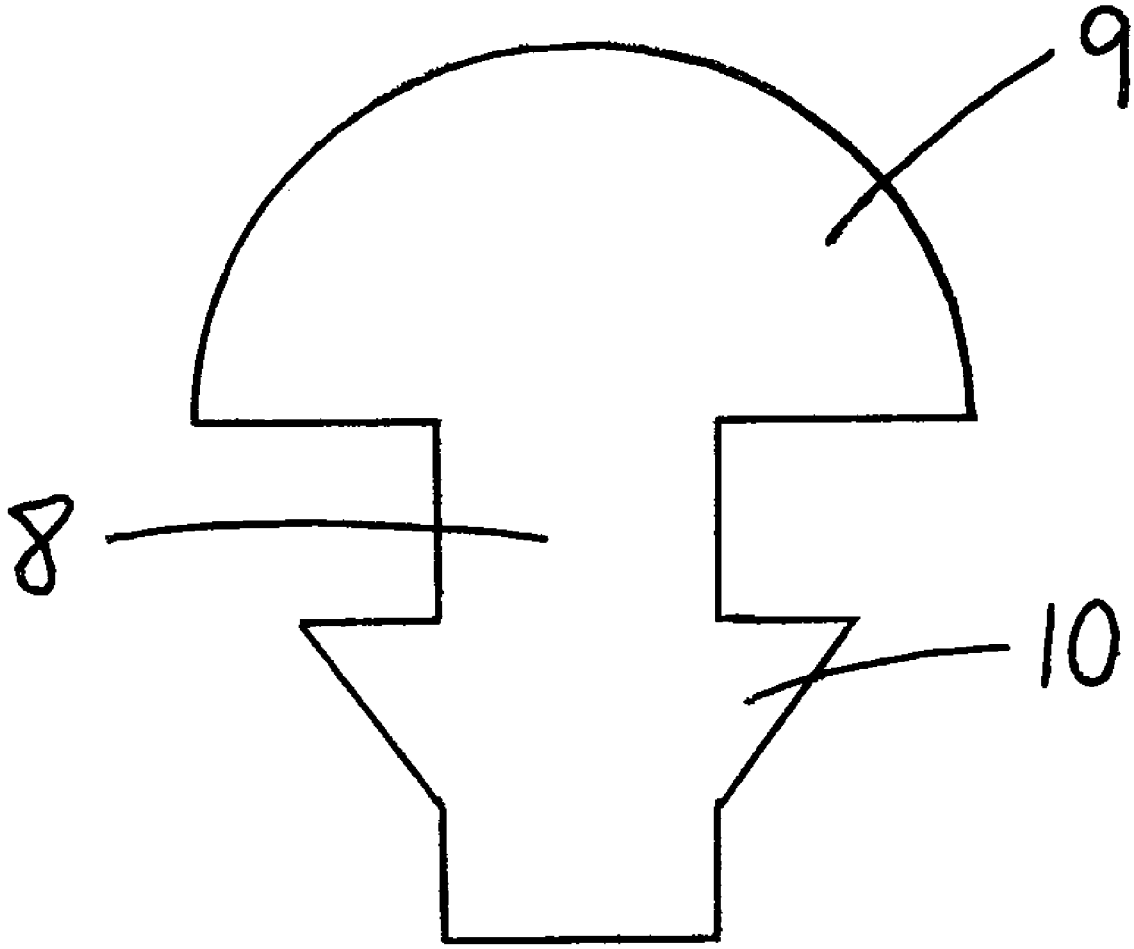
FIG. 5 is an end view of a fret adapted for insertion into a fingerboard of a stringed instrument.

With reference to FIGS. 2-4, the common features of the various embodiments will now be described in which a section of a neck assembly for a stringed instrument is shown. A neck assembly 1 for a stringed musical instrument features the fingerboard 3 mounted on the top surface of the neck 2. The fingerboard features slots 5 recessed into a top surface 6 of the fingerboard for receiving a plurality of frets 7. Each fret comprises a stem or "tang" 8 at the bottom and a cap 9 at the top as shown in FIGS. 1 and 5. A fret is installed by inserting the tang 8 into the slot 5 such that the cap 9 is supported by the top surface 6 of the fingerboard 3 on either side of the slot. To keep each fret from coming lose, there is a plurality of studs 10 spaced along the length of the fret. The studs 10 protrude from each side of the tang 8 so as to engage the fret 7 to the fingerboard 3 on each side of the slot 5. The slots, and therefore the frets inserted into the slots, are spaced at a predetermined distance from one another based on a change in the length of a vibrating string required to change the tone produced by the vibrating string by a certain amount. Knowledge of this spacing is well-known to those of skill in the art and won't be further explained here.

The present invention is concerned with a stringed instrument where the strings 4 contain ferromagnetic material, such as, but not limited to steel. In a first embodiment of the invention shown in FIG. 2, the frets 7 are made from a permanently magnetic material, such as, but not limited to neodymium. The particular magnetic material for making the frets is chosen based on its magnetic strength. The magnetic field around a fret must be strong enough so that when a string 4 is pressed against the fret 7 by the downward force of a player's finger the string and fret should be held securely together, but the magnetic field cannot be so strong as to hold the string 4 and fret 7 together when the force exerted by the player's finger is removed. The tension of a string 4 between the supporting point on the body 21 and the supporting point near the end of the neck 22 ensures a straight line of travel between these two points unless the string is acted upon by an external force of significant magnitude, such as a force exerted by a finger of the player of the instrument. The magnetic field of a fret 7 is of a predetermined strength such that the force exerted on the strings 4 is not of a sufficient magnitude to overcome this tension on its own, nor is it of a sufficient magnitude to interfere with the vibration of a string that is not being pressed against that particular fret.

A second embodiment of the invention is illustrated in FIG. 3. This embodiment differs from the first in that the frets 7 are made of a magnetizable material rather than a permanently magnetic material. Each fret 7 is magnetized by a magnet 11 mounted immediately beneath and in contact with the fret. Each magnet is mounted in a cavity 12 recessed in the bottom surface of the fingerboard. The cavity extends high enough into the fingerboard such that it just overlaps with the slot 5 recessed in the top surface of the fingerboard 3. In order to maintain the fingerboard 3 as a single piece of material, the cavities 12, unlike the slots 5, do not extend the full width of the fingerboard. The magnets 11 are positioned within the cavities 12 such that the poles of the magnets are facing a direction normal to the top surface of the fingerboard 6. The magnets 11 magnetize the frets 7 which in turn exhibit a downward pulling force on the strings 4. The magnets 11 and the magnetizable material used for the frets 7 in this embodiment are chosen based on the resulting strength of the magnetic field of the frets, keeping in mind the requirements set out in the first embodiment.

A third embodiment of the invention is illustrated in FIG. 4. As in the second embodiment, the frets 7 are made of a magnetizable material rather than a permanently magnetic material. Instead of magnetizing each fret 7 with a magnet, a wire 13 is run through along a channel 16 recessed in the bottom surface 14 of the fingerboard and coiled around an extension portion 15 of each fret extending downward from the tang 8 such that each fret 7 becomes an electromagnet when current is passed through the wire 13. The extension portion 15 may feature at least one notch or channel in at least one edge or surface at a height where the wire 13 is coiled around the extension portion 15 in order to ensure that when tightly coiled, the wire can't move along a vertical axis. As shown in FIG. 1, a power supply for the electromagnetic frets can be mounted either on a surface of the instrument body 20 as shown at 23 or within a body cavity 25 recessed in a surface of the body 20 as shown at 24. As in the second embodiment, a cavity 12 recessed in the bottom surface of the fingerboard 14 beneath each fret 7 is necessary in order to provide adequate space for the wire 13 to be coiled around the extension portion 15 of the fret. The wire 13 is coiled around the end of the extension portion 15 nearest the cap 9 just below the tang 8 so that the opposing electromagnetic poles are created at the uppermost portion of the fret (the cap 9) and the lowermost portion of the fret (the end of the extension portion 15 opposite the cap). The pole created at the cap 9 exerts a downward pulling force on the strings 4 as in the other embodiments of the invention. The power supply and the number of wraps in the coil of wire at each fret are chosen such that the resulting magnetic field is of a strength meeting the requirements set out in the first embodiment.

Different styles of frets and methods of mounting frets on a fingerboard are known to those of skill in the art and can be applied to the present invention. For example, a fret 7 made with magnetic material comprising a cap 9 with no tang 8 or studs 10 could be mounted directly on the top surface 6 of the fingerboard 3 using an adhesive.

In summary, the present invention relates to magnetizing the frets of a stringed musical instrument, such as a guitar, in order to increase the bond between a string and fret. The magnetic field can be produced by using magnetic frets, using steel frets with magnets embedded underneath or alongside them, or connecting frets to electromagnetic coils connected to a power supply such as a battery or wall outlet. The magnetic force helps the steel string adhere to the fret, eliminating the buzz sound associated with playing a string when contact between the string and fret is not complete. The invention allows for a margin of error in finger placement between frets and the amount of force applied to the string by beginning players of the instrument.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A fret arranged for use with a stringed instrument, the stringed instrument having:

a body;

a neck extending from the body:

a fingerboard supported along the neck and arranged for supporting the fret thereon; and a plurality of strings spanning along the fingerboard comprised of ferromagnetic material and arranged for contacting the fret when playing the instrument;

the fret being arranged to emit a magnetic field having a strength which is insufficient to hold one of the strings and the fret together when a force exerted by a finger of a player of the stringed instrument is removed from the string.

2. The fret of claim 1 wherein the fret comprises magnetic material arranged for emitting the magnetic field.

3. The fret of claim 1 wherein there is provided a magnetic element in association with the fret arranged for emitting the magnetic field.

4. The fret of claim 3 wherein the magnetic element comprises magnetic material in proximity to the fret.

5. The fret of claim 1 wherein there is provided an electromagnetic coil in association with the fret arranged for emitting the magnetic field.

6. The fret of claim 5 wherein the electromagnetic coil is arranged around at least a portion of the fret.

7. A stringed instrument comprising:

a body;

a neck extending from the body;

a fingerboard supported along the neck;

a plurality of frets supported at spaced positions along the fingerboard; and a plurality of strings spanning along the fingerboard, the strings comprising ferromagnetic material;

each fret being arranged to emit a magnetic field having a strength which is insufficient to hold one of the strings and the fret together when a force exerted by a finger of a player of the stringed instrument is removed from the string; and the magnetic field having a strength which is not sufficient to alone overcome tension of the strings.

8. The stringed instrument of claim 7 wherein each fret comprises magnetic material arranged for emitting the magnetic field.

9. The stringed instrument of claim 7 wherein there is provided a magnetic element in association with each fret arranged for emitting the magnetic field.

10. The stringed instrument of claim 9 wherein each magnetic element comprises magnetic material in proximity to a corresponding one of the plurality of frets.

11. The stringed instrument of claim 7 wherein there is provided an electromagnetic coil in association with each fret arranged for emitting the magnetic field.

12. The stringed instrument of claim 11 wherein each electromagnetic coil is arranged around at least a portion of a corresponding one of the plurality of frets.

13. The stringed instrument of claim 11 wherein there is provided a power supply arranged for supplying current to the electromagnetic coils.

14. The stringed instrument of claim 13 wherein the power supply is mounted on a surface of the body of the stringed instrument.

15. The stringed instrument of claim 13 wherein the power supply is mounted within a cavity recessed into the body of the stringed instrument.

16. A neck arranged for use with a stringed instrument having a body for supporting the neck to extend therefrom and a plurality of strings comprised of ferromagnetic material arranged for spanning along the neck, the neck comprising:

a fingerboard; and a plurality of frets at spaced positions along the fingerboard, each fret being arranged to emit a magnetic field having a strength which is insufficient to hold one of the strings and the fret together when a force exerted by a finger of a player of the stringed instrument is removed from the string.

17. The neck of claim 16 wherein each fret comprises magnetic material arranged for emitting the magnetic field.

18. The neck of claim 16 wherein there is provided a magnetic element in association with each fret arranged for emitting the magnetic field.

19. The neck of claim 18 wherein each magnetic element comprises magnetic material in proximity to a corresponding one of the plurality of frets.

20. The neck of claim 16 wherein there is provided an electromagnetic coil in association with each fret arranged for emitting the magnetic field.

21. The neck of claim 20 wherein each electromagnetic coil is arranged around at least a portion of a corresponding one of the plurality of frets.

* * * * *